US006151458A

United States Patent [19]

Sato et al.

[11] Patent Number: 6,151,458

[45] Date of Patent: Nov. 21, 2000

[54] SHEET DETECTING DEVICE AND IMAGE FORMING APPARATUS PROVIDED WITH THE SAME

[75] Inventors: Hitoshi Sato, Kawasaki; Takashi Kimura, Yokohama, both of Japan

[73] Assignee: Canon Kabushiki Kaisha, Tokyo, Japan

[21] Appl. No.: 09/404,749

[22] Filed: Sep. 24, 1999

[30] Foreign Application Priority Data

Feb. 10, 1998 [JP] Japan ..... 10-281737

[51] Int. Cl.[7] ..... G03G 15/00; B65H 7/02

[52] U.S. Cl. ..... 399/16; 399/322; 399/389; 271/265.01; 271/265.02

[58] Field of Search ..... 271/258.01, 258.05, 271/259, 261, 265.01, 265.03, 265.02; 399/16, 322, 388, 389, 397, 400, 405

[56] References Cited

U.S. PATENT DOCUMENTS

| | | | |
|---|---|---|---|
| 4,699,366 | 10/1987 | Kashimura et al. | 271/4 |
| 4,793,605 | 12/1988 | Tajima | 271/9 |
| 5,539,510 | 7/1996 | Yamashiro et al. | 399/389 |
| 5,913,510 | 6/1999 | Kiyohara et al. | 271/4.01 |
| 5,964,460 | 12/1999 | Azumi et al. | 271/265.01 |

*Primary Examiner*—William Royer
*Assistant Examiner*—Hoang Ngo
*Attorney, Agent, or Firm*—Fitzpatrick, Cella, Harper & Scinto

[57] ABSTRACT

A sheet detecting device for contacting with a sheet being conveyed and detecting the sheet is provided with a first moving member urged and moved by the sheet being moved, N (N≧1) interlocking members moved in operative association with the movement of the first moving member, a second moving member moved in operative association with the movement of the N interlocking members, a detection signal producing portion producing a sheet detection signal on the basis of the movement of the second moving member, first biasing member provided on the first moving member for independently biasing the moved first moving member in a direction opposite to the direction of movement thereof so as to return it to its original position, N biasing member provided on respective ones of the N interlocking members for independently biasing the moved N interlocking members in a direction opposite to the direction of movement thereof so as to return them to their original positions, and second biasing member provided on the second moving member for independently biasing the moved second moving member in a direction opposite to the direction of movement thereof so as to return it to its original position.

8 Claims, 4 Drawing Sheets

SHEET DETECTING DEVICE AND IMAGE FORMING APPARATUS PROVIDED WITH THE SAME

BACKGROUND OF THE INVENTION

1. Field of the Invention

This invention relates to a sheet detecting device and an image forming apparatus provided with the same, and particularly to the construction of sheet detecting means.

2. Related Background Art

There has heretofore been an image forming apparatus of the electrophotographic type or the electrostatic recording type in which for example, a visible image is formed on an image bearing member and this visible image is transferred to a transfer material which is a sheet to thereby obtain an image. And as an example of such an apparatus, there is a polychromatic or monochromatic electrophotographic copying apparatus, a laser beam printer or the like.

Now, in such an image forming apparatus, it is necessary to reliably effect the feeding and conveyance of a transfer material to the image bearing member and the discharge of the transfer material having a visible image transferred thereto and fixed thereon. So, in order to confirm that the feeding, conveyance and discharge of this transfer material are effected reliably, transfer material detecting devices which are a plurality of sheet detecting means are provided on the route of feeding, conveyance and discharge. Further, a transfer material detecting device for detecting the twining or the like of the transfer material onto the roller of a fixing device is also provided immediately behind (near the downstream side) the fixing device for fixing the toner image on the transfer material.

The transfer material detecting devices each comprise a flag which is a first member urged and pivotally moved by the transfer material when the transfer material passes it, and a photosensor which is a detection signal producing portion adapted to be turned on/off by the pivotal movement of the flag and produce a sheet detection signal. This flag is provided with biasing means such as a spring, and after the transfer material has passed, the flag is adapted to be pivotally moved and returned to its position before its pivotal movement by this biasing means.

On the other hand, in the transfer material detecting device of such a construction, when a photosensor cannot be disposed near the flag is construction, this is, when the photosensor cannot be directly turned on/off by the flag, a second member moved with the pivotal movement of the flag is provided and the photosensor is adapted to be turned on/off by the movement of this member.

After the transfer material has passed, the flag pivotally moved and the second member moved with the pivotal movement of the flag are adapted to be returned to their original positions or their original states by the biasing means for biasing the flag.

However, when in the prior-art image forming apparatus provided with the thus constructed transfer material detecting device, the second member moved with the pivotal movement of the flag is provided, the following problem has arisen in some cases because only the flag, or in some cases, only the second member is provided with the biasing means.

The flag and the second member together are biased by a single biasing means and therefore, if the biasing force of the biasing means is made great so that, for example, the flag and the second member can be reliably returned to their original positions, the contact pressure between the flag and the transfer material may become great and the transfer material may be injured or the contacting portion of the flag may be greatly worn. If conversely, the biasing force of the biasing means is made small so as to make the contact pressure between the flag and the transfer material small, the flag and the second member will not be returned to their original positions even after the transfer material has passed.

SUMMARY OF THE INVENTION

The present invention has been made in view of such present situation, and has as its object to provide a sheet detecting device in which a flag member operates stably and the injury of transfer materials (sheets) and the wear or the like of the flag member do not occur, and an image forming apparatus provided with the same.

The present invention is a sheet detecting device for contacting with a conveyed sheet and detecting the sheet, characterized by the provision of a first moving member urged and moved by the conveyed sheet, a second moving member moved in operative association with the movement of the first moving member, a detection signal producing portion producing a sheet detection signal on the basis of the movement of the second moving member, and first and second biasing means provided on the first and second moving members, respectively, for independently biasing the first and second moving member in a direction opposite to the direction of movement thereof so as to return the moved first and second moving members to their original positions.

Also, the present invention is a sheet detecting device for contacting with a conveyed sheet and detecting the sheet, characterized by the provision of:

a first moving member urged and moved by the conveyed sheet;

N ($N \geqq 1$) interlocking members moved in operative association with the movement of the first moving member;

a second moving member moved in operative association with the movement of the N interlocking members;

a detection signal producing portion producing a sheet detection signal on the basis of the movement of the second moving member;

first biasing means provided on the first moving member for independently biasing the moved first moving member in a direction opposite to the direction of movement thereof so as to return it to its original position;

N biasing means provided on respective ones of the N interlocking members for independently biasing the moved N interlocking members in a direction opposite to the direction of movement thereof so as to return them to their original positions; and second biasing means provided on the second moving member for independently biasing the moved second moving member in a direction opposite to the direction of movement thereof so as to return it to its original position.

DESCRIPTION OF THE PREFERRED EMBODIMENTS

Some embodiments of the present invention will hereinafter be described in detail with reference to the drawings.

Figure 1:
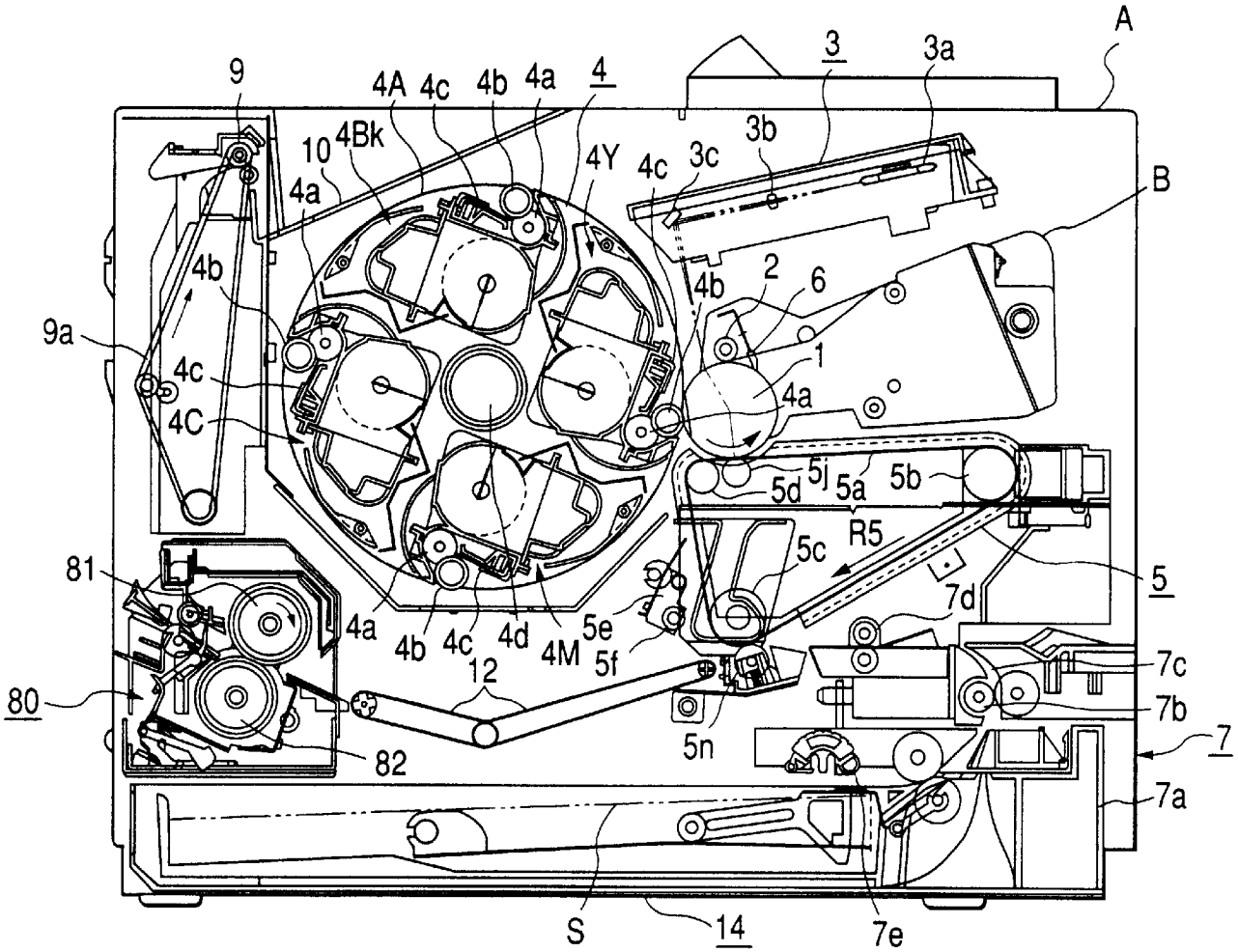
FIG. 1 is a cross-sectional view showing the construction of a full color laser beam printer adopting the electrophotographic method which is used in an image forming apparatus according to a first embodiment of the present invention.

FIG. 1 is a cross-sectional view showing the construction of a full color laser beam printer adopting the electrophotographic method which is used in an image forming apparatus according to a first embodiment of the present invention.

In FIG. 1, the letter A designates a laser beam printer provided with a drum type electrophotographic photosensitive member (hereinafter referred to as the photosensitive drum) 1.

The photosensitive drum 1 comprises, for example, an aluminum cylinder having a diameter of about 47 mm, and an organic photoconductive material layer (OPC photosensitive material) applied to the outer peripheral surface thereof. Also, the photosensitive drum 1 has its opposite end portions rotatably supported by support members (not shown), and a driving force from a drive motor (not shown) is transmitted to one end portion of the photosensitive drum 1, whereby the photosensitive drum 1 may be rotatively driven in a counter-clockwise direction as indicated by arrow.

Further, a charging device 2 for uniformly charging the surface of the photosensitive drum, exposure means 3 for applying a laser beam on the basis of image information to thereby form an electrostatic latent image on the photosensitive drum, a developing unit 4 for causing toners to adhere to the electrostatic latent image and developing it as a toner image, a transfer unit 5 to which the toner image on the photosensitive drum is primary-transferred, a cleaning device 6 for removing any untransferred toner remaining on the surface of the photosensitive drum after the primary transfer, etc. are successively disposed around the photosensitive drum 1 in accordance with the direction of rotation thereof.

The charging device 2 is of the so-called contact charging type as shown, for example, in Japanese Laid-Open Patent Application No. 63-149669, and the charging device (electrically conductive roller) 2 is brought into contact with the surface of the photosensitive drum and a charging bias is applied to this charging device (electrically conductive roller) 2 by a voltage source (not shown) to thereby uniformly charge the surface of the photosensitive drum.

Also, the exposure means 3 has a polygon mirror 3*a* to which an image light corresponding to an image signal is applied by a laser diode (not shown) and which rotates at a high speed by a scanner motor (not shown), and is designed such that the image light is reflected by the polygon mirror 3*a* and the surface of the photosensitive drum 1 is selectively exposed to this reflect image light through the intermediary of an imaging lens 3*b* and a reflecting mirror 3*c* or the like to thereby form an electrostatic latent image.

Also, the developing unit 4 is provided with a rotatable member 4A index-rotatable about a shaft 4*d,* and four developing devices 4Y, 4M, 4C and 4Bk containing yellow, magenta, cyan and black toners therein respectively and carried on the rotatable member 4A. The developing devices 4Y, 4M, 4C and 4Bk are individually removably mountable with respect to the rotatable member 4A, which in turn is removably mountable with respect to the main body 14 of the apparatus.

During the development of the electrostatic latent image on the photosensitive drum 1, predetermined one of the developing devices 4Y, 4M, 4C and 4Bk of the colors which should adhere to the electrostatic latent image is stopped at a developing position opposed to the photosensitive drum 1 by the index rotation of the rotatable member 4A, and then the developing sleeve 4*b* of the developing devices 4Y, 4M, 4C and 4Bk is positioned so as to be opposed to the photosensitive drum 1 with a minute spacing (of the order of 300 $\mu$m) therebetween, and thereafter develops the electrostatic latent image on the photosensitive drum 1.

This development is done in the following manner.

The toner in the container of one of the developing devices 4Y, 4M, 4C and 4Bk which corresponds to the color to develop is first fed onto an application roller 4*a* by a feeding mechanism (not shown), and then a thin layer of the toner is applied to the outer periphery of the rotating developing sleeve 4*b* by the rotating application roller 4*a* and a toner regulating blade 4*c,* and charges are imparted (triboelectrically charged) to the toner.

Thereafter, a developing bias is applied to between the developing sleeve 4*b* and the photosensitive drum 1 on which the electrostatic latent image has been formed, whereby the toner is caused to adhere to the electrostatic latent image to thereby develop it as a toner image. When disposed at the developing position, each of the developing devices 4Y, 4M, 4C and 4Bk is adapted to be connected to a high voltage source for each color development (not shown) provided in the main body 14 of the apparatus, whereby a voltage for each color development is selectively applied to the developing sleeve 4*b* of the developing devices 4Y, 4M, 4C and 4Bk.

Also, the transfer unit 5 is such that the developed toner images are transferred (primary-transferred) and the color toner images successively transferred from the photosensitive drum 1 are superposed one upon another, and the plurality of superposed toner images are collectively transferred (secondary-transferred) to a transfer material S. This transfer unit 5 is provided with an intermediate transfer belt 5*a* moved in the direction of arrow R5.

In the present embodiment, this intermediate transfer belt 5*a* is a belt having a circumference of about 440 mm, and is passed over three rollers, i.e., a drive roller 5*b,* a secondary transfer opposed roller 5*c* and a driven roller 5*d.* A voltage of the opposite polarity to the toners is adapted to be applied to the driven roller 5*d* when the toner images are primary-transferred, whereby the toner images on the photosensitive drum 1 are primary-transferred onto the intermediate transfer belt 5*a.*

The transfer unit 5 is further provided with a keep roller 5*j* proximate to the driven roller 5*d* and retractable so as to assume a position for urging the intermediate transfer belt 5*a* against the photosensitive drum 1, and a position in which the intermediate transfer belt 5*a* separates from the photosensitive drum 1.

At a predetermined location outside the intermediate transfer belt 5*a,* there is provided a cleaning unit 5*e* for removing any untransferred toner remaining on the intermediate transfer belt 5*a* after secondary transfer is collectively effected to the transfer material S, as will be described later.

This cleaning unit 5*e* is provided with a charging roller 5*f* movable toward and away from the surface of the intermediate transfer belt 5*a,* and this charging roller 5*f* may be brought into contact with the intermediate transfer belt 5*a* to thereby give charges of the opposite polarity to that during the transfer to the toners. When thus given charges of the opposite polarity to that during the transfer, the toners may electrostatically adhere to the photosensitive drum 1, and thereafter may be collected by the cleaning device 6 for the photosensitive drum 1 which will be described later.

The method of cleaning the intermediate transfer belt 5*a* is not limited to the above-described electrostatic cleaning, but may be a mechanical method such as a blade or a four brush, or a method using these together.

Also, the cleaning device 6 removes the so-called untransferred toners not primary-transferred but left on the surface of the photosensitive drum after the toners developed on the photosensitive drum by the developing unit 4 is primary-transferred. The photosensitive drum 1, the charging device 2 and the cleaning device 6 are integrally made into a cartridge to form a process cartridge B which is detachably mountable on the main body 14 of the laser beam printer A.

Also, in FIG. 1, the reference numeral 7 designates feeding means for feeding the transfer material S toward the transfer unit 5, and the reference numeral 12 denotes conveying means for conveying the transfer material S.

The feeding means 7 serves to feed the transfer material S to an image forming portion comprised of the developing unit 4 and the process cartridge B, and is provided with a feeding cassette 7*a* containing a plurality of transfer materials S therein and inserted in the lower portion of the main body 14 of the apparatus. It is designed such that during image formation, a pickup member 7*e* and a conveying roller 7*b* are rotatively driven in response to the image forming operation to thereby separate and feed the transfer materials S in the feeding cassette 7*a* one by one and guide them by a guide plate 7*c,* and feed them to the intermediate transfer belt 5*a* through registering rollers 7*d.*

Also, the conveying means 12 serves to convey the transfer material S after the secondary transfer to a fixing device 80, and is comprised of a plurality of belts or the like.

On the other hand, the fixing device 80 is for applying heat and pressure to the transfer material S which has passed a secondary transfer roller 5*n* for collectively transferring the toners on the intermediate transfer belt 5*a* to thereby fix the toner images of plural colors on the surface of the transfer material. The construction and operation of this fixing device 80 will be described later.

Description will now be made of the image forming operation of the thus constructed laser beam printer.

First, in synchronism with the rotation of the intermediate transfer belt 5*a,* the photosensitive drum 1 is rotated in the direction of arrow (counter-clockwise direction) in FIG. 1 and the surface of the photosensitive drum 1 is uniformly charged by the charging device 2 and also, at first, the application of the light of a yellow image is effected by the exposure means 3 to thereby form a yellow electrostatic latent image on the photosensitive drum 1.

Also, simultaneously with the formation of this electrostatic latent image, the developing unit 4 is driven to thereby dispose the yellow developing device 4Y at the developing position and a voltage of the same polarity as the charging polarity of the photosensitive drum 1 and of substantially the same potential as the potential of the photosensitive drum 1 is applied to the developing sleeve 4*b* of the developing device 4Y to thereby cause the yellow toner to adhere to the electrostatic latent image and develop the latent image.

Thereafter, a voltage of the opposite polarity to the toner is further applied to the primary transfer roller (driven roller) 5*d* to thereby primary-transfer type yellow toner image on the photosensitive drum 1 onto the intermediate transfer belt 5*a.*

When the primary transfer of the yellow toner image is terminated in this manner, the next developing device is rotatively moved and positioned at the developing position opposed to the photosensitive drum 1. Thereafter, in the same manner as the case of yellow, the development and primary transfer of the electrostatic latent image are successively effected with respect to the magenta, cyan and black colors, and the toner images of the four colors are superposed on the intermediate transfer belt 5*a.* Thereafter, these toner images are collectively secondary-transferred to the transfer material S supplied from the conveying means 7.

Next, the transfer material S to which the secondary transfer has been thus effected is conveyed to the fixing device 80, by which the fixing of the toner images is effected, whereafter the transfer material is discharged onto a discharge tray 10 outside the main body of the apparatus by a belt 9*a* moved in the direction of arrow in FIG. 1 and a discharge roller 9 driven by this twined belt 9*a,* thus terminating image formation.

Figure 2:
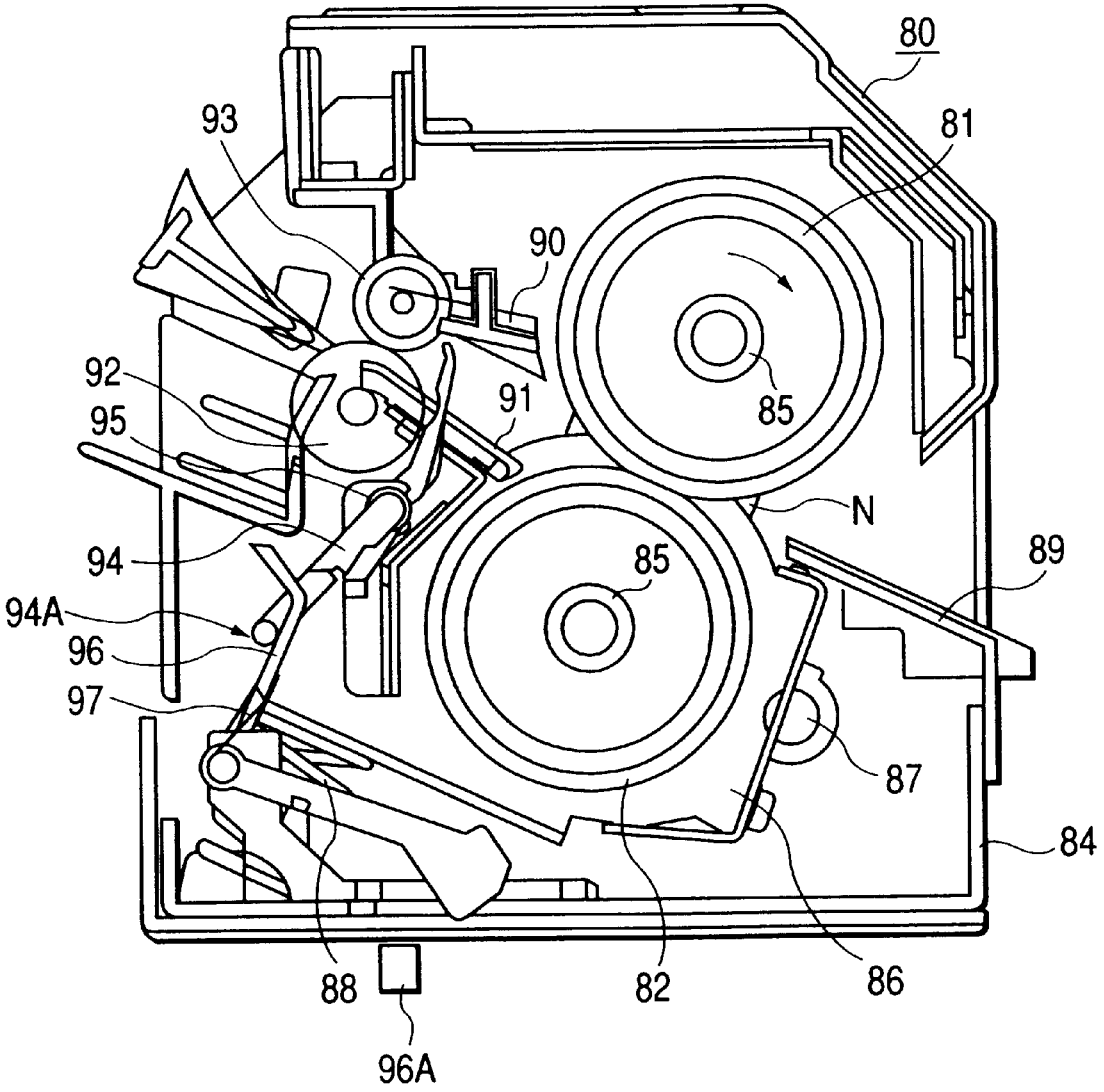
FIG. 2 is a schematic cross-sectional view of the fixing device of the laser beam printer of FIG. 1.

Now, the fixing device 80, as shown in FIG. 2, has a fixing roller 81 as a fixing rotatably member and a pressure roller 82 as a pressing rotatable member. Each of the fixing roller 81 and the pressure roller 82 comprises a metallic pipe (mandrel) and an elastic material layer, and a halogen heater 85 is disposed in each of the rollers 81 and 82.

The fixing roller 81 has its opposite end portions rotatably supported on a fixing frame 84 through bearings (not shown), and the pressure roller 82 has its opposite end portions rotatably supported on a pressure frame 86 through bearings (not shown). This pressure frame 86 is pivotally supported on the fixing frame 84 by a support shaft 87 fixed to the fixing frame 84 and also is biased by a pressure spring 88 so that the pressure roller 82 may be urged against the fixing roller 81.

Further, a gear (not shown) is mounted on one end of the fixing roller 81 for rotation with the fixing roller 81, and is adapted to be rotatively driven in the direction of arrow (clockwise direction) by the driving force of driving means (not shown) transmitted through a gear. Also, the pressure roller 82 is urged against the fixing roller 81 and therefore, when the fixing roller 81 is rotated, the pressure roller 82 is adapted to be rotated thereby.

On the other hand, in FIG. 2, the reference numeral 89 designates an entrance guide disposed near the upstream side of the fixing roller 81 and the pressure roller 82, and the transfer material S may be guided to the nip portion N between the fixing roller 81 and the pressure roller 82 by this entrance guide 89.

Also, an upper discharge guide 90, a lower discharge guide 91, a fixing discharge roller 92, a roller 93 opposed to the discharge roller, etc. are disposed near the downstream side of the fixing roller 81 and the pressure roller 82, and the transfer material S fixed by the fixing roller 81 and the pressure roller 82 may be guided by the upper discharge guide 90 and the lower discharge guide 91, and thereafter may be discharged by the fixing discharge roller 92.

Now, in FIG. 2, the reference character 94A designates a transfer material detecting device provided downstream of the fixing roller 81 and the pressure roller 82, and this transfer material detecting device 94A is provided with a flag 94 which is a first member, a lever 96 which is a second member pivotally moved in operative association with the pivotal movement of the flag 94, and a photosensor 96A which is a detection signal producing portion for detecting the pivotal movement of the lever 96 and producing a sheet detection signal.

The flag 94 of this transfer material detecting device 94A has its upper end portion upwardly protruded by the lower discharge guide 91 and is supported for pivotal movement toward the low discharge guide so as to be pressed and pivotally moved by the passing transfer material S, while on the other hand, it is biased in a direction opposite to the direction of pivotal movement by a first torsion coil spring 95 which is first biasing means. Also, the lever 96 is pivotally supported so as to be pivotally moved in operative association with the pivotal movement of the flag 94 and also is biased in a direction opposite to the direction of pivotal movement by a second torsion coil spring 97 which is second biasing means.

By the flag 94 and the lever 96 being thus biased in the direction opposite to the direction of pivotal movement by the first torsion coil spring 95 and the second torsion coil spring 97, respectively, when the transfer material S passes after the flag 94 and the lever 96 have been pivotally moved with the passage of the transfer material S, the flag 94 and the lever 96 may be quickly returned to their positions before the pivotal movement by the first and second torsion coil springs 95 and 97.

That is, the torsion coil springs 95 and 97 are provided for the flag 94 and the lever 96, respectively, as described above, and the flag 94 and the lever 96 are biased independently of each other by these torsion coil springs 95 and 97, respectively, whereby the flag 94 and the lever 96 can be operated stably.

It is preferable that the biasing force of the first torsion coil spring 95 be such that when the transfer material S urges the flag 94, the contact pressure between the transfer material S and the flag 94 is of a magnitude equal to or less than predetermined pressure by which the transfer material S is not injured. By the biasing force of the first torsion coil spring 95 being of such a magnitude, the injury of the transfer material S and the wear of the flag 94 during the detection of the transfer material can be prevented.

On the other hand, the photosensor 96A is adapted to be turned off with an optical path (not shown) opened by the lever 96 before this lever 96 is pivotally moved, and to be turned on with the optical path closed when the lever 96 is pivotally moved.

Description will now be made of the transfer material detecting operation of the thus constructed transfer material detecting device 94A.

When the transfer material S is conveyed to the fixing device 80 after secondary transfer is effected, this transfer material S is guided by the entrance guide 89 of the fixing device 80 and comes into the nip portion N between the fixing roller 81 and pressure roller 82 which are being rotatively driven. Heat and pressure are applied to the transfer material S when its passes through the nip portion between the fixing roller 81 and the pressure roller 82, whereby the toner images of plural colors are fixed on the surface of the transfer material.

Figure 3:
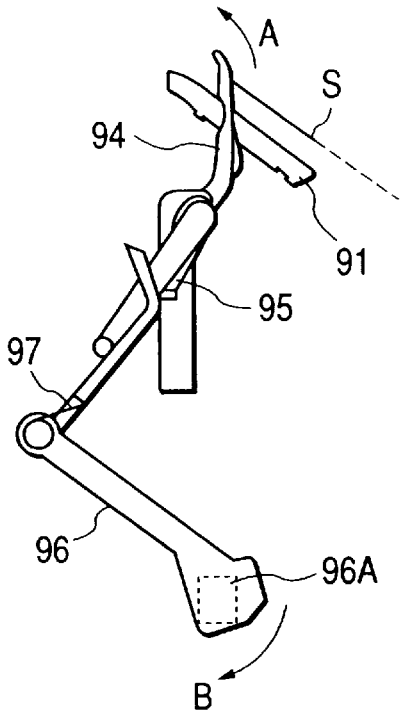
FIG. 3 illustrates the transfer material detecting operation of a transfer material detecting device provided in the fixing device of FIG. 2.

After the transfer material S has passed through the nip portion N, the leading end thereof contacts with the flag 94 as shown in FIG. 3. Thereby, the flag 94 is pivotally moved in the direction of arrow A against the biasing force of the torsion coil spring 95, and in operative association therewith, the lever 96 is also pivotally moved in the direction of arrow B against the biasing force of the torsion coil spring 97.

When the lever 96 is thus pivotally moved, the photosensor 96A so far turned off with the optical path opened becomes turned on with the optical path closed by the lever 96. The ON signal of this photosensor 96A is inputted as a sheet detection signal to a control device (not shown) provided at a predetermined location in the main body 14 of the apparatus to control the feeding, conveyance and discharge of the transfer material S, whereby the control device judges that the transfer material S is conveyed without twining round the fixing roller 81 and the pressure roller 82.

On the other hand, when the transfer material S passes thereafter, the flag 94 and the lever 96 are quickly returned to their positions before pivotally moved shown in FIG. 2 by the torsion coil spring 95 and 97.

By the torsion coil springs 95 and 97 being provided for the flag 94 and the lever 96, respectively, as described above, the flag 94 and the lever 96 can be operated stably and the injury of the transfer material S and the wear of the flag 94 can be prevented.

A second embodiment of the present invention will now be described.

Figure 4:
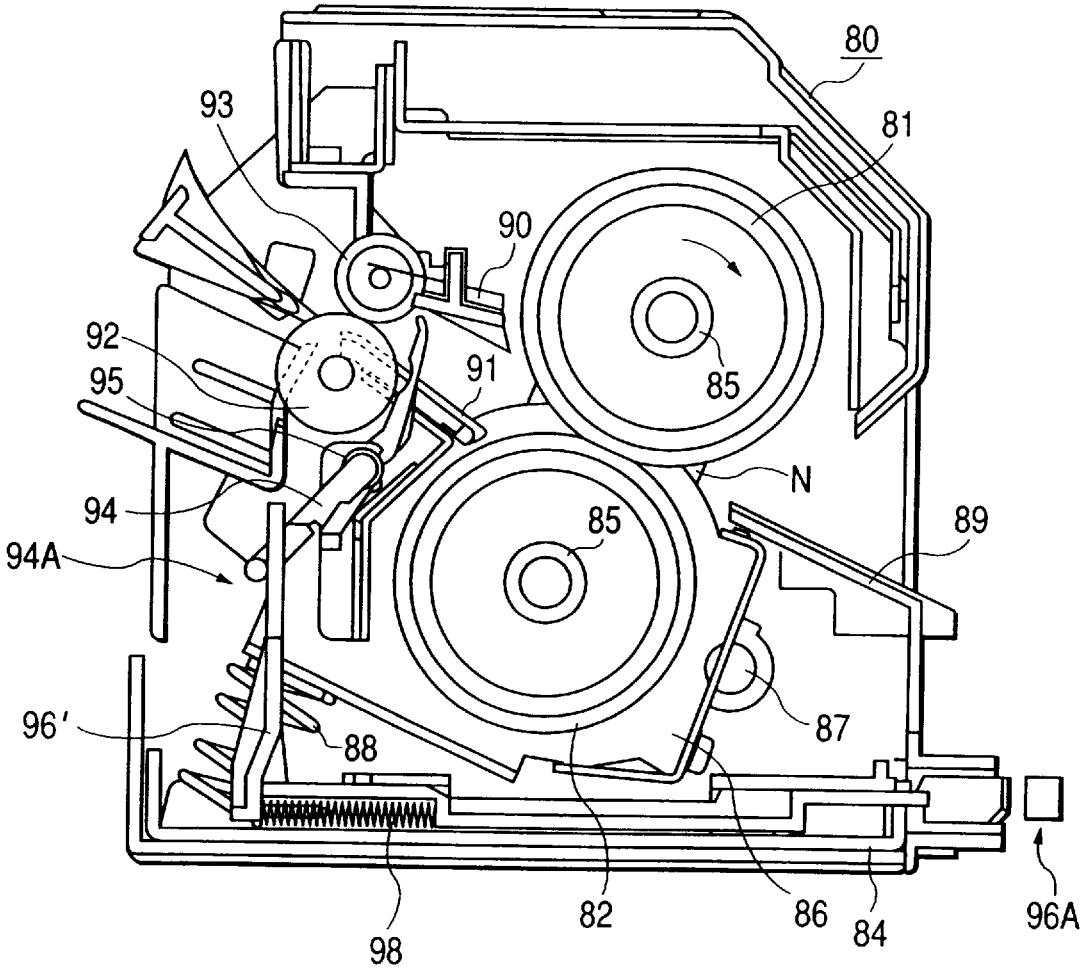
FIG. 4 is a schematic cross-sectional view of the fixing device of a laser beam printer according to a second embodiment of the present invention.

FIG. 4 shows the construction of the fixing device of an image forming apparatus according to the present embodiment. In FIG. 4, the same reference characters as those in FIG. 2 designate the same or corresponding portions.

In FIG. 4, the reference numeral 96' denotes a lever which is supported on a fixing frame 84 for sliding in a horizontal direction. The reference numeral 98 designates a compression coil spring which biases the lever 96' in a direction opposite to the sliding direction.

Description will now be made of the transfer material detecting operation of the thus constructed transfer material detecting device 94A.

When the transfer material S is conveyed to the fixing device 80 after secondary transfer is effected, this transfer material S is guided by the entrance guide 89 of the fixing device 80 and enters the nip portion N between the fixing roller 81 and the pressure roller 82 which are being rotatively driven. Thereafter, heat and pressure are applied to the transfer material, whereby toner images of plural colors are fixed on the surface of the transfer material.

Figure 5:
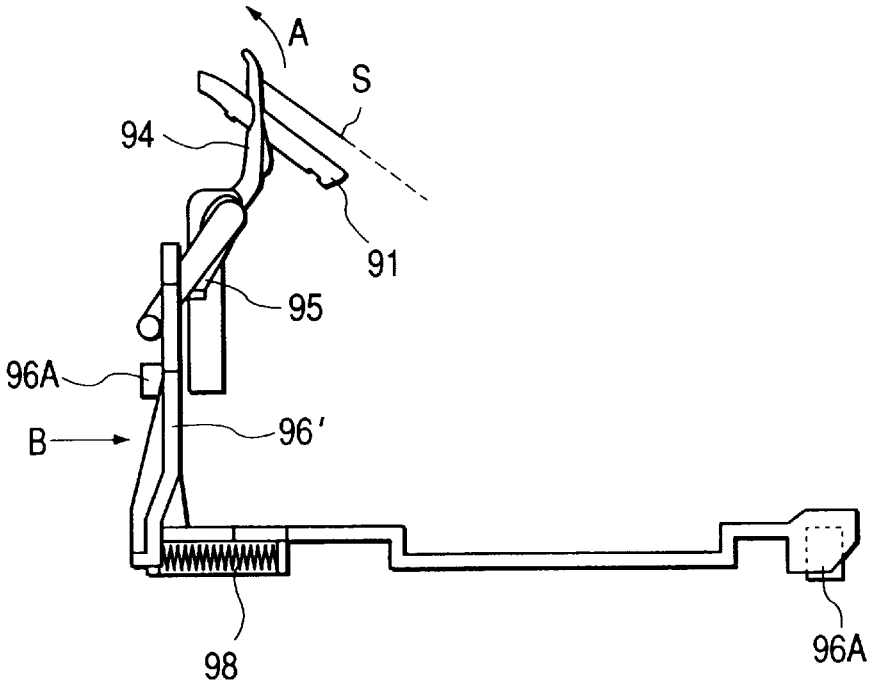
FIG. 5 illustrates the transfer material detecting operation of a transfer material detecting device provided in the fixing device of FIG. 4.

Next, after the transfer material S has passed through this nip portion N, the leading end thereof contacts with the flag 94 as shown in FIG. 5. Thereby, the flag 94 is pivotally moved in the direction of arrow A against the biasing force of the first torsion coil spring 95, and in operative association therewith, the lever 96' slides in the direction of arrow B against the biasing force of the compression coil spring 98.

When the lever 96' slides thus, the photosensor 96A so far turned off with the optical path opened is turned on with the optical path closed by the lever 96'. Thereby, the control device judges that the transfer material S is conveyed without twining round the fixing roller 81 and the pressure roller 82.

On the other hand, when the transfer material S passes thereafter, the flag 94 and the lever 96' are quickly returned to their positions before pivotal movement and sliding shown in FIG. 4 by the first torsion coil spring 95 and the compression coil spring 98, respectively.

By the first torsion coil spring 95 and the compression coil spring 98 being thus provided for the flag 94 and the lever 96', respectively, the flag 94 and the lever 96' can be operated stably and the injury of the transfer material S and the wear of the flag 94 can be prevented.

In the embodiments hitherto described, a laser beam printer adopting the electrophotographic method has been exemplified as an example of the image forming apparatus, whereas the present invention is not restricted, thereto, but may be an image forming apparatus adopting other recording method such as the ink jet method.

Also, the present invention may be other image forming apparatus such as a copying apparatus or a facsimile apparatus instead of a printer, and may further be, for example, a monochromatic image forming apparatus capable of forming black and white images, instead of a polychromatic image forming apparatus capable of forming color images.

Further, in the foregoing description, the transfer material detecting device according to each embodiment has been described as being disposed in the fixing device portion, whereas the present invention is not restricted thereto, but of course can be applied to the supplying portion, the conveying portion or the like for the transfer material.

Also, in the above-described embodiments, design is made to produce a sheet detection signal for moving the second moving member in operative association with the first moving member, but N ($N \geqq 1$) moving members may be interposed between the first moving member and the second moving member.

What is claimed is:

1. A sheet detecting device for contacting with a sheet being conveyed and detecting the sheet, comprising:

a first moving member urged and moved by said sheet being conveyed;

N ($N \geqq 1$) interlocking members moved in operative association with the movement of said first moving member;

a second moving member moved in operative association with the movement of said N interlocking members;

a detection signal producing portion producing a sheet detection signal on the basis of the movement of said second moving member;

first biasing means provided on said first moving member for independently biasing said moved first moving member in a direction opposite to the direction of movement thereof so as to return it to its original position;

N biasing means provided on respective ones of said N interlocking members for independently biasing said moved N interlocking members in a direction opposite to the direction of movement thereof so as to return them to their original positions; and second biasing means provided on said second moving member for independently biasing said moved second moving member in a direction opposite to the direction of movement thereof so as to return it to its original position.

2. The sheet detecting device of claim 1, characterized in that the biasing force of the first biasing means provided on said first moving member is set such that when the sheet being conveyed urges said first moving member, a contact force between said sheet and said first moving member assumes a predetermined value.

3. The sheet detecting device of claim 1, characterized in that a contact force between said sheet and said first moving member is 0.5 to 1.0.

4. The sheet detecting device of claim 1, characterized in that said first biasing means, said N biasing means and said second biasing means are springs.

5. A sheet detecting device for contacting with a sheet being conveyed and detecting the sheet, comprising:

a first moving member urged and moved by said sheet being conveyed;

a second moving member moved in operative association with the movement of said first moving member;

a detection signal producing portion producing a sheet detection signal on the basis of the movement of said second moving member;

first biasing means provided on said first moving member for independently biasing said moved first moving member in a direction opposite to the direction of movement thereof so as to return it to its original position; and second biasing means provided on said second moving member for independently biasing said moved second moving member in a direction opposite to the direction of movement thereof so as to return it to its original position.

6. The sheet detecting device of claim 5, characterized in that the biasing force of the first biasing means provided on said first moving member is set such that when the sheet being conveyed urges said first moving member, a contact pressure between said sheet and said first moving member assumes a predetermined value.

7. The sheet detecting device of claim 5, characterized in that said first biasing means and said second biasing means are springs.

8. The sheet detecting device of claim 5, characterized in that a contact force between said sheet and said first moving member is 0.5 to 1.0.

* * * * *

UNITED STATES PATENT AND TRADEMARK OFFICE

CERTIFICATE OF CORRECTION

PATENT NO. : 6,151,458
DATED : November 21, 2000
INVENTOR(S) : Hitoshi Sato et al.

It is certified that error appears in the above-identified patent and that said Letters Patent is hereby corrected as shown below:

Title page,
Item [30], Foreign Application Priority Data,
"Feb. 10, 1998 [JP] Japan …. 10-281737" should read
-- Oct. 2, 1998 [JP] Japan …. 10-281737 --.

Column 4,
Line 7, "predetermined" should read -- a predetermined --.
Line 26, "to" should be deleted.

Column 5,
Line 17, "is" should read -- are --.

Column 6,
Line 26, "rotably" should read -- rotatable --.

Column 7,
Line 55, "its" should read -- it --.

Column 8,
Line 13, "before" should read -- before being --.

Column 9,
Line 6, "method" should read -- methods --.

Signed and Sealed this

Eleventh Day of May, 2004

JON W. DUDAS
*Acting Director of the United States Patent and Trademark Office*